US006722900B2

(12) United States Patent
Segawa et al.

(10) Patent No.: US 6,722,900 B2
(45) Date of Patent: Apr. 20, 2004

(54) POWER PLUG WITH ELASTIC PIECES FOR POSITIONING

(75) Inventors: Shinichi Segawa, Kyoto (JP); Seung Heon Lee, Inchon (KR)

(73) Assignee: Japan Storage Battery Co., Ltd., Kyoto (JP)

( * ) Notice: Subject to any disclaimer, the term of this patent is extended or adjusted under 35 U.S.C. 154(b) by 0 days.

(21) Appl. No.: 10/132,414

(22) Filed: Apr. 26, 2002

(65) Prior Publication Data

US 2002/0173183 A1 Nov. 21, 2002

(30) Foreign Application Priority Data

Apr. 27, 2001 (JP) ..... 2001-133021

(51) Int. Cl.[7] ..... H01R 13/44; H01R 13/60
(52) U.S. Cl. ..... 439/131; 439/640; 439/956
(58) Field of Search ..... 439/131, 171–174, 439/956, 640

(56) References Cited

U.S. PATENT DOCUMENTS 6,042,400 A * 3/2000 Queffelec et al. ..... 439/131
6,270,364 B1 * 8/2001 Wang ..... 439/131
6,312,271 B1 * 11/2001 Tseng ..... 439/131

FOREIGN PATENT DOCUMENTS

JP 3096896 5/1998 ..... H01R/13/46

* cited by examiner

*Primary Examiner*—Hae Moon Hyeon
(74) *Attorney, Agent, or Firm*—Wenderoth, Lind & Ponack L.L.P.

(57) ABSTRACT

A prismatic (18) having a square cross-section is provided in a rotation shaft (16) to which plug terminals (14) are fixed. The rotation shaft (16) is sandwiched between a pair of elastic pieces (17*a*), (17*a*) of an elastic holder (17), so that the respective elastic pieces (17*a*), (17*a*) are brought into contact with plane surfaces of the prismatic bar (18) parallel to each other. Therefore, an interval between the two elastic pieces (17*a*), (17*a*) of the elastic holder (17) is increased when the square bar (18) rotates, so that a firm and steady touch of a click can be provided.

7 Claims, 3 Drawing Sheets

POWER PLUG WITH ELASTIC PIECES FOR POSITIONING

BACKGROUND OF THE INVENTION

1. Field of the Invention

The present invention relates to a power plug with plug terminals provided rotatably with respect to a housing.

2. Description of the Prior Art

Some chargers for a portable electric device have a power plug having a pair of plug terminals that can rotate between a projecting position, where tips thereof project from a housing made of synthetic resin, and an accommodated position, where the tips are housed in an accommodation part of the housing. When using such a charger, the plug terminals are brought to their projecting position for insertion into an outlet. When the charge is not used, however, the plug terminals can be accommodated in the housing so as to be out of the way.

Such power plugs include one disclosed in Japanese Patent No. 3096896. In this plug, a pair of plug terminals are held by bases thereof embedded into a rotation shaft member made of synthetic resin, and the rotation shaft member is rotatably supported on the housing. By rotating the rotation shaft member, the plug terminals are displaced from the accommodated position, where they are accommodated in the housing, to the projecting position, where they project from the housing. The housing has a pair of elastic pieces, opposed to each other, that are provided integrally therewith near the rotation shaft member. The rotation shaft member has an engagement pin in the shape of a round bar, and the engagement pin enters into a gap between the pair of elastic pieces as the rotation shaft member rotates. The engagement pin expands the gap between the elastic pieces while entering therein and is held in that position. Thus, the plug terminals are held in the projecting position thereof.

However, in the above described arrangement in which the round-bar-like engagement pin enters by force into the gap between the elastic pieces, a significant displacement of the elastic pieces cannot be set, and a sufficient touch of a click cannot be provided. To enhance the touch of a click, it is necessary to upsize the engagement pin or the like. However, due to the restriction on the overall size of the power plug, the upsizing of the engagement pin or the like is also restricted.

This invention has been developed in view of the above described circumstances, and an object thereof is to provide a power plug capable of providing a firm and steady touch of a click.

SUMMARY OF THE INVENTION

According to the present invention, a rotation shaft for integrally supporting a set of plug terminals is received on a bearing of a housing. Thus, the plug terminals are supported rotatably with respect to the housing. The rotation shaft comprises a prismatic bar with a peripheral surface including a plurality of plane surfaces and ridges between the plane surfaces, and a pair of elastic pieces positioned to sandwich the rotation shaft therebetween is brought into contact with the plurality of plane surfaces of the prismatic bar. The pair of elastic pieces are arranged not to rotate with the rotation shaft and, as the rotation shaft rotates, are elastically deformed to expand by pressure from the ridge of the prismatic bar. Here, when the rotation shaft is rotated by rotating the plug terminals, the ridges of the prismatic bar press the elastic pieces outwardly. Therefore, the distance between the elastic pieces is repeatedly increased and decreased with the rotation of the rotation shaft. A firm and steady touch of a click is provided when the rotation shaft rotates from a first angle position, where the distance between the elastic pieces is the narrowest, to a second angle position where the distance becomes the narrowest once it has become the widest.

In such an arrangement, a large displacement of the elastic pieces can be set according to the cross-section of the prismatic bar, and a more obvious touch of a click can be provided compared to a prior art arrangement in which the round-bar-like engagement pin simply enters into the gap between a pair of elastic pieces.

Furthermore, in the case where the plug terminals are locked at an angle of 90 degrees as in the prior art arrangement described above, the cross-section of the prismatic bar is preferably formed into a square shape. In such an arrangement, the increase and decrease in the distance between the elastic pieces are repeated every 90 degrees of rotation, so that the plug terminals can be rotated with a simple angle interval to provide a touch of a click.

In addition, the elastic pieces are preferably formed as parts separate from the housing and mounted on the housing in a detention state.

In the prior art arrangement described above, in which the elastic pieces are formed integrally with the housing made of resin, it may be difficult to select a material for the elastic pieces that has a sufficient strength, such as elasticity, wear resistance and rigidity, or to form the material into a shape with these properties. Therefore, by separating the elastic pieces from the housing, an appropriate material can be used for the elastic pieces, or the elastic pieces can be readily formed into an optimal shape.

DESCRIPTION OF THE PREFERRED EMBODIMENTS

Figure 1:
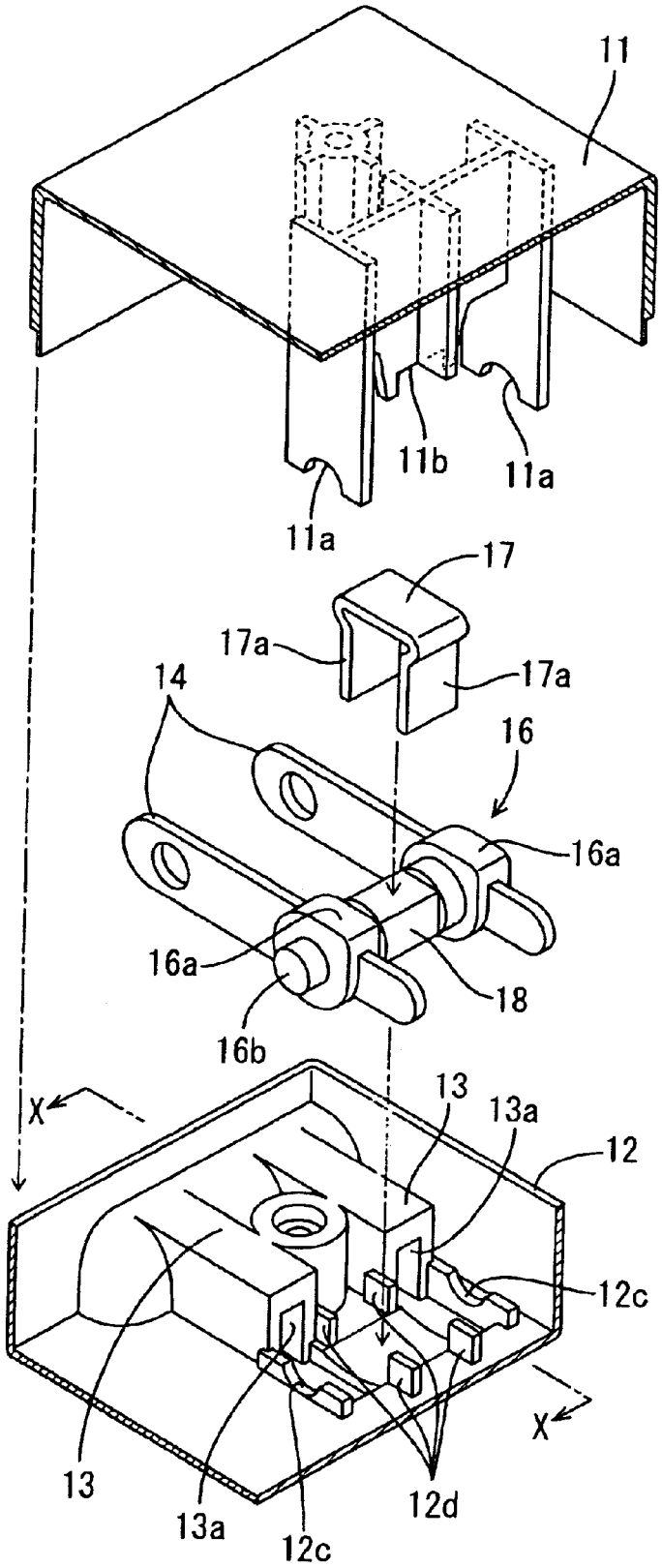
FIG. 1 is an exploded perspective view of a power plug portion of a charger according to an embodiment of the present invention.

An embodiment of the present invention will be described below with reference to FIGS. 1 to 3. A power plug in this embodiment is provided in a charger for a portable electric device, for example, in such a manner that plug terminals thereof can rotate with respect to a housing of the charger. In FIG. 1, only the power plug portion of the charger is shown.

As shown in FIG. 1, the charger has plug terminals 14 fixed to a rotation shaft 16, an elastic holder 17, and an AC/DC converter circuit board (not shown) accommodated between an upper case 11 and a lower case 12. The upper case 11 and the lower case 12 are both square cases made of resin, and form a box-like housing 10 with a space therein by joining the cases at their openings.

The plug terminals 14 are a set of two elongated conductive blades made of metal, which are to be inserted into an outlet of an AC Power Supply. The plug terminals are formed integrally with the rotation shaft 16 by piercing through both ends of the shaft. The rotation shaft is made of resin and placed horizontally, and parallel tips of the plug terminals to be inserted into the outlet project forward. The rotation shaft 16 has laterally projecting stoppers 16*a*, 16*a* formed on an outer periphery thereof at positions associated with the positions where the respective plug terminals 14 pierce therethrough. When the plug terminals 14 are in the projecting position, as described later, the stoppers 16*a*, 16*a* abut against walls of slits 13*a*, 13*a* formed in rear walls of accommodation parts 13, 13 to prevent further rotation of the plug terminals 14. In addition, the rotation shaft 16 has shaft end parts 16*b*, 16*b* having a smaller diameter and which are located outside of the pierced positions.

Here, when the plug terminals 14 are in the projecting position, base portions of the plug terminals 14 projecting rearward from the rotation shaft 16 come into contact with a conductive terminal (not shown) to function as contact terminals for electrically connecting the plug terminals 14 with the AC/DC converter circuit board.

The lower case 12 has, at a forward end thereof, a pair of accommodation parts 13, 13 for accommodating the plug terminals 14, and the accommodation parts 13, 13 are formed by pressing a bottom surface of the case into a box-like shape. The slits 13*a*, 13*a*, through which the plug terminals 14 are to be passed, are formed in the rear walls of the accommodation parts 13, 13. In addition, a pair of lower bearings 12*c*, 12*c* for supporting the shaft end parts 16*b*, 16*b* of the rotation shaft 16 are provided in a rearward position of the slits 13*a*, 13*a* to be offset outwardly from the slits.

The upper case 11 has a pair of upper bearings 11*a*, 11*a* that project downwardly from the ceiling surface so as to oppose the lower bearings 12*c*, 12*c* of the lower case 12. When the upper case 11 is put on and fixed to the lower case 12, the upper bearings 11*a*, 11*a* cover the top surfaces of the shaft end parts 16*b*, 16*b* of the rotation shaft 16 supported by the lower bearings 12*c*, 12*c* of the lower case, thereby holding the rotation shaft 16 so that it can rotate without floating upward.

By the arrangement as described above, the pair of plug terminals 14 can be rotated with respect to the housing 10 between-the projecting position, in which the tips thereof project downwardly, and the accommodated position, in which the tips are accommodated in the accommodation parts 13, 13 while being directed forwardly. When the plug terminals 14 are in the projecting position, the stoppers 16*a*, 16*a* that are formed on the rotation shaft 16 abut against the walls of the slits 13*a*, 13*a* to stop rotation of the rotation shaft in the first direction. When the terminals 14 are in the accommodated position, the tips of the plug terminals 14 abut against the ceiling surface of the accommodation parts 13, 13 to stop rotation of the rotation shaft in the second direction. Therefore, the plug terminals 14 are prevented from rotating beyond an angle range of about 90 degrees between the positions.

In this embodiment, the rotation shaft 16 for holding the plug terminals 14 has a center portion formed into a prismatic bar 18 in which a cross-section perpendicular to the axial direction of shaft 16 is a square. The prismatic bar 18 is designed so that a set of parallel faces thereof is parallel with a longitudinal direction of the plug terminals 14, while another set of parallel faces is perpendicular to the longitudinal direction of the plug terminals 14, and the faces have edges (ridges) therebetween.

A U-shaped elastic holder 17 is made of resin and has a high elasticity, and comprises a pair of elastic pieces (legs) 17*a*, 17*a* for holding the prismatic bar 18 along the opposed sides of the square-shaped cross-section and a connecting portion for interconnecting the leg pieces. The pair of elastic pieces and the connecting portion are formed integrally (i.e., as one-piece, as shown in FIG. 1). The interval between the pair of elastic pieces (legs) 17*a*, 17*a* opposed to each other is substantially the same as the length of one side of the square-shaped cross-section of the prismatic bar 18 of the rotation shaft 16. As shown in FIGS. 1 to 3, the connections (joint portions) between the respective elastic pieces (legs) 17*a*, 17*a* and the connecting portion are thicker than the other portions, and inner walls thereof are curved surfaces having circular cross-sections. This arrangement is intended for avoiding concentration of stress on these bent portions when a bias by the prismatic bar 18 of the rotation shaft 16 occurs.

The elastic holder 17 is mounted from above in such a manner that the tips of the elastic pieces (legs) 17*a*, 17*a* are directed downwardly and the prismatic bar 18 of the rotation shaft 16 supported by the bearings 12*c*, 12*c* is sandwiched between the elastic pieces (i.e., the elastic holder straddles the prismatic bar). The mounted elastic holder 17 is limited in its movement in the axial direction of the rotation shaft 16 by four projections 12*d* provided on the bottom surface of the lower case 12. In addition, when the upper case 11 is put on and fixed to the lower case 12, the elastic holder 17 is also limited in its upward movement by a pressure piece 11*b* abutting against the top surface of the elastic holder 17. The pressure piece 11*b* has a tip end having an angled U-shape, and is formed between the upper bearings 11*a*, 11*a* of the upper case 11. Thus, the elastic holder 17 (elastic pieces 17*a*, 17*a*) is not associated with the rotation of the rotation shaft 16 and is mounted on the housing 10 in a detention state.

Now, an action of the above described arrangement during rotation of the plug terminals 14 will be described with reference to FIGS. 2 and 3.

Figure 2:
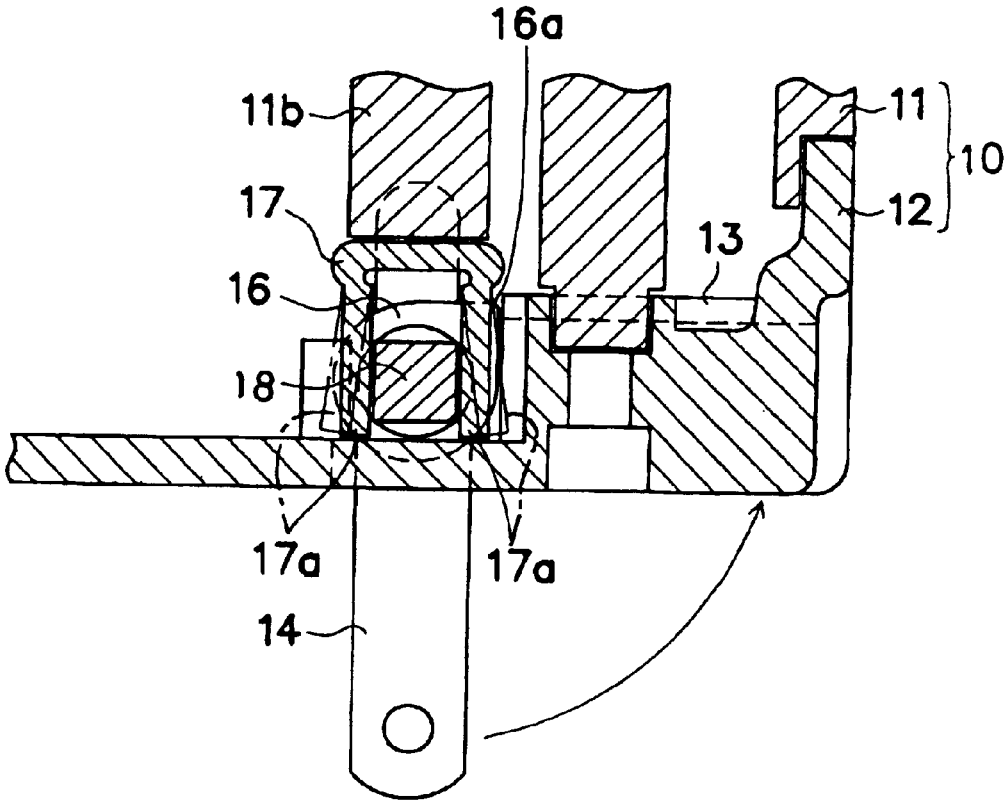
FIG. 2 is a cross-sectional view of the power plug portion taken along the line X—X in FIG. 1, in which plug terminals are in a projecting position.
Figure 3:
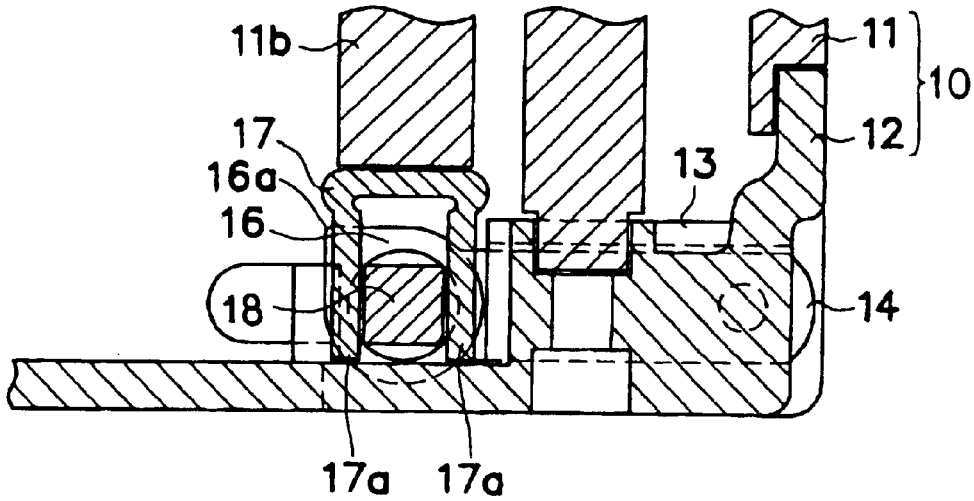
FIG. 3 is a cross-sectional view of the power plug portion taken along the line X—X in FIG. 1, in which plug terminals are in an accommodated position.

FIG. 2 is a cross-sectional view of the power plug portion at the time when the plug terminals 14 are in the projection position. At this time, one pair of parallel surfaces of the prismatic bar 18 is parallel to the elastic pieces (legs) 17*a*, 17*a* of the elastic holder 17. Therefore, the elastic pieces 17*a*, 17*a* are in contact with the parallel surfaces of the prismatic bar 18 with the narrowest interval between the elastic pieces, and thus, the plug terminals 14 are locked so as not to be readily rotated. If the plug terminals 14 are forcedly rotated to an angle less than 45 degrees to rotate the prismatic bar 18, the rotation shaft 16 receives a force to return the plug terminal 14 to the original position due to the restoring force of the elastic pieces 17*a*, 17*a* expanded as indicated by the alternate long and short dashed line in the drawing. However, if the plug terminals 14 are forcedly rotated to an angle equal to or more than 45 degrees, the restoring force of the elastic pieces 17*a*, 17*a* exerted on the prismatic bar 18 becomes a force to further rotate the rotation shaft 16 to 90 degrees, so that the tips of the plug terminals 14 can be directed forward and accommodated in the accommodation parts 13, 13, as shown in FIG. 3. The same goes for the case where the plug terminals 14 are rotated in the opposite direction to be moved into the projection position.

As described above, the power plug according to this embodiment is arranged so that the prismatic bar 18 of the rotation shaft 16 is sandwiched between the pair of elastic pieces (legs) 17*a*, 17*a* that is mounted on the housing 10 in the detention state. This arrangement can provide a firm and steady touch of a click when the plug terminals 14 are rotated, as compared to a prior art arrangement in which a round-bar-like engagement pin simply enters into a gap between a pair of elastic pieces. Furthermore, since the outer periphery of the prismatic bar 18 slides along a pair of elastic pieces 17*a*, 17*a*, wear of both members 17 and 18 due to the rotation of the plug terminals 14 can be suppressed and a good touch of a click can be maintained for a long time compared to the prior art arrangement in which the engagement pin is susceptible to deformation, wear and the like, during the rotation.

Since the interval between the elastic pieces (legs) 17*a*, 17*a* of the elastic holder 17 is repeatedly increased and decreased with each rotation of the prismatic bar 18 of the rotation shaft 16, the elastic holder must have an appropriate strength in terms of elasticity, wear resistance, rigidity and the like. Therefore, the elastic holder 17 is preferably made of a material that is different from that of the housing 10 and has superior properties, particularly the above properties. In this embodiment, the elastic holder 17 is a separate part from the upper case 11 and the lower case 12 and thus, the elastic holder 17 can be made of any material freely selected and formed into any shape regardless of the material of the housing 10.

Furthermore, since the elastic holder 17 with a pair of elastic pieces 17*a*, 17*a* for sandwiching the prismatic bar 18 is integrally formed, it can be easily mounted on the housing 10.

The present invention is not limited to the above described embodiment. For example, embodiments as described below fall within the technical scope of this invention, and various other modifications are possible without departing from the spirit of this invention.

(1) In the above described embodiment, the prismatic bar 18 is provided at the center portion of the rotation shaft 16. However, the prismatic bar may be provided at any position on the rotation shaft 16 including both ends thereof, for example.

(2) In the above described embodiment, the plug terminals 14 rotate only within the angle range of 90 degrees. However, the plug terminals may rotate within a wider angle range including 360 degrees, and a touch of a click may be produced every 90 degrees. In addition, the plug terminals may not be accommodated in the housing 10. For example, the power plug may have plug terminals that always project externally and can rotate with respect to the housing 10 in this state.

(3) In the above described embodiment, the cross-section of the prismatic bar 18 is a square. However, it is not limited thereto, and may be a regular triangle or any other regular polygon. In this case, the plug terminals 14 rotate while producing a touch of a click every angle position corresponding to the number of vertices of the regular polygon. Alternatively, any polygon other than a regular polygon is possible. In this case, the angle positions in the rotation of the plug terminals 14 are irregular, so that the touch of a click can be varied. In addition, the vertices of the polygon of the cross-section of the prismatic bar 18 may be chamfered or formed into curved surfaces having circular cross-sections to reduce the resistance during the rotation of the plug terminals 14.

(4) In the above described embodiment, the elastic holder 17 having the two opposed elastic pieces 17*a*, 17*a* formed integrally therewith has been described. However, the elastic pieces 17*a*, 17*a* may be separate plate members provided separately on the upper case 11 and the lower case 12 so as to be opposed to each other.

(5) In the above described embodiment, the prismatic bar 18 is sandwiched between the surfaces of the pair of elastic pieces 17*a*, 17*a* that are opposed substantially parallel to each other. However, the shape of the opposed surfaces may be arbitrarily determined according to the cross-section of the prismatic bar 18.

For example, if the cross-section of the prismatic bar 18 is a polygon having an odd number of vertices, such as a regular pentagon, the parallel surfaces may sandwich the prismatic bar therebetween with only one of the surfaces being arranged along a side of the prismatic bar 18. Alternatively, the other of the surfaces may be formed into a depressed shape so as to be arranged along the angled portion of the prismatic bar 18.

Furthermore, if both the opposed surfaces of the elastic holder 17 are formed into a depressed shape, the prismatic bar 18 having a cross-section of a polygon with an even number of vertices can be sandwiched by the holder with ridges thereof on both sides being along the opposed surfaces.

(6) In the above described embodiment, the prismatic bar 18 is sandwiched between the opposed surfaces of the elastic holder 17. However, the prismatic bar 18 may be sandwiched between two bars or the like.

(7) In the above described embodiment, the elastic holder 17 is a separate part from the housing 10. However, so far as a sufficient strength can be attained in terms of elasticity and the like, the elastic holder may be constituted by two projections provided on the case 11 or case 12. This arrangement allows the assembly of the power plug to be simplified.

(8) In the above described embodiment, the power plug for a charger with a set of two plug terminals 14 has been described. However, a power plug with a set of three or more plug terminals 14 or with a grounding terminal along with the plug terminals 14 may be implemented similarly.

Figure 4:
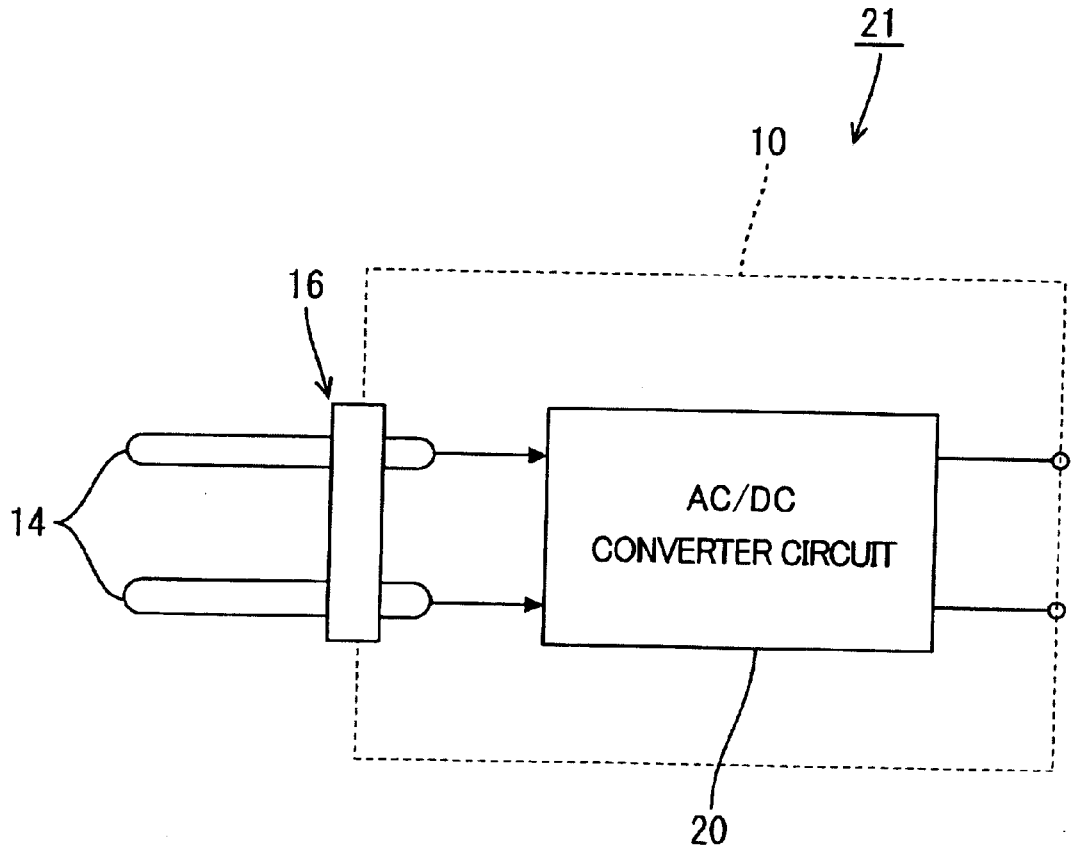
FIG. 4 is a schematic circuit diagram of an AC adapter having an AC/DC converter circuit.

(9) In the above described embodiment, an example in which the power plug is provided in the charger for a secondary battery integrated in a portable electric device or the like has been described. However, an installation portion may be separated from the charger and implemented in an AC adapter 21 that performs only conversion to a DC voltage with an AC/DC converter circuit 20 (see FIG. 4) or in a typical power plug without the AC/DC converter circuit 20 or the like. Furthermore, this invention may be applied to any device other than the charger so far as the device has a power plug.

What is claimed is:

1. A power plug comprising:

a rotation shaft having a prismatic bar with a plurality of peripheral planar surfaces and ridges between said planar surfaces, said rotation shaft being operable to rotate in a first direction and a second direction;

a set of plug terminals integrally connected to said rotation shaft so as to be spaced apart along said rotation shaft;

a housing having a bearing for rotatably supporting said rotation shaft such that said rotation shaft is operable to rotate in the first direction and the second direction; and an elastic holder having a pair of elastic pieces sandwiching said prismatic bar of said rotation shaft so as to elastically deform due to contact pressure from said ridges between said planar surfaces of said prismatic bar as said rotation shaft rotates, said elastic holder further having a connecting portion formed at one end of said elastic pieces so as to interconnect said elastic pieces, and having a connection between each of said elastic pieces and said connecting portion, said connection between each of said elastic pieces and said connecting portion having an inner curved surface with a circular cross-section, said elastic holder being separate from said housing and being arranged so as not to rotate with said rotation shaft.

2. The power plug of claim 1, wherein said pair of elastic pieces are arranged so as to contact a pair of said planar surfaces of said prismatic bar when said elastic pieces are not being deformed due to the contact pressure from said ridges.

3. The power plug of claim 1, wherein said joint portion has a thickness greater than a thickness of each of said elastic pieces and greater than a thickness of said connecting portion.

4. A power plug comprising:

a rotation shaft having a prismatic bar with a plurality of peripheral planar surfaces and ridges between said planar surfaces;

a set of plug terminals integrally connected to said rotation shaft so as to be spaced apart along said rotation shaft;

a housing having a bearing for rotatably supporting said rotation shaft such that said rotation shaft is operable to rotate in a first direction and a second direction; and a pair of elastic pieces sandwiching said prismatic bar of said rotation shaft, and being operable to elastically deform due to contact pressure from said ridges between said planar surfaces of said prismatic bar as said rotation shaft rotates, said pair of elastic pieces being arranged so as not to rotate with said rotation shaft, and so as to contact a pair of said planar surfaces of said prismatic bar when said elastic pieces are not being deformed due to contact pressure from said ridges.

5. The power plug of claim 4, wherein said prismatic bar has a square cross-section.

6. The power plug of claim 4, wherein said elastic pieces are separate from said housing, and are detained within said housing.

7. The power plug of claim 4, wherein said prismatic bar has an even number of planar surfaces, said elastic pieces being arranged so as to contact a pair of parallel planar surfaces of said prismatic bar, and being connected to each other by a connecting portion formed at one end of said elastic pieces.

* * * * *